United States Patent [19]

Avison et al.

[11] 4,395,147

[45] Jul. 26, 1983

[54] DAISY WHEEL PRINTER

[75] Inventors: Gerald Avison, Cambridge; Philip T. Blenkinsop, Herts, both of England

[73] Assignee: Spiralux Limited, Kent, England

[21] Appl. No.: 279,758

[22] Filed: Jul. 2, 1981

[30] Foreign Application Priority Data

Jul. 9, 1980 [GB] United Kingdom ..... 8022459

[51] Int. Cl.[3] ..... B41J 1/30

[52] U.S. Cl. ..... 400/144.2; 400/174

[58] Field of Search ..... 400/144.2, 144.3, 174, 400/175; 101/93.17-93.19

[56] References Cited

FOREIGN PATENT DOCUMENTS 2545311 4/1976 Fed. Rep. of Germany ... 400/144.2

*Primary Examiner*—Paul T. Sewell

*Attorney, Agent, or Firm*—Oblon, Fisher, Spivak, McClelland & Maier

[57] ABSTRACT

A daisy wheel printer wherein a non-contacting sensor (24) is employed to detect the rotational position of the daisy wheel (10) by response to the interrupting action of the character stalks (12, 14) and to produce a train of pulses providing positional information in accordance with said interrupting action. In accordance with the invention, each stalk of the daisy wheel is divided by a longitudinal slit (26) into two or more branches (28, 20) thereby to increase the frequency of the interrupting action and, for a given rotation of the wheel, to cause the sensor to produce a train of pulses (32) containing a number of pulses which is an integral multiple of the number of stalks passing the sensor.

6 Claims, 3 Drawing Figures

DAISY WHEEL PRINTER

FIELD OF THE INVENTION

This invention relates to a daisy wheel printer, i.e. a printer having a printing head incorporating a flat wheel which has a plurality of radial stalks carrying embossed characters.

BACKGROUND TO THE INVENTION

In a daisy wheel printer, it is necessary, in accordance with character selection by keyboard, computer or other character selecting means, to move the selected character to an operative position for imprinting of said character by an impacting mechanism such as a hammer. For this purpose, the position of the daisy wheel as it rotates must be precisely monitored. Commonly, a position transducer in the form of an encoder is mounted on the daisy wheel shaft or on the output shaft of a motor, i.e. a servomotor or stepper motor, which is used to rotate the daisy wheel to bring the selected character to the operative position. An alternative and inexpensive means for providing positional information is to observe the stalks of the daisy wheel as it rotates with a light beam or other non-contacting means which is interrupted by the moving stalks. The observing sensor produces pulses representing quantized positional information as to the rotational position of the daisy wheel (relative to a datum or home position). However, because each stalk passing the sensor only produces one pulse, the resolution of the positional information is poor, and there is a degree of uncertainty as to the precise position of the daisy wheel.

It is an object of this invention to enable positional information of increased resolution to be obtained with a non-contacting sensor.

THE INVENTION

According to the invention, there is provided a printer having a printing head incorporating a daisy wheel and a non-contacting sensor which is dependent on the interrupting action of the stalks of the daisy wheel during rotation thereof to produce a train of pulses representing quantized information as to the position of the daisy wheel, wherein the stalks of the daisy wheel at a common radial zone detected by the sensor are each apertured to increase the frequency of the interrupting action and thereby produce, for a given rotation of the daisy wheel, a pulse train containing a number of pulses which is a multiple of the number of stalks passing the sensor.

Preferably each stalk is split, at said radial zone, by one or more longitudinal slit-like apertures which divide the stalk into two or more branches. If a single slit is provided in each stalk, the number of pulses for a given wheel rotation will be doubled as compared to the number of pulses produced by non-divided stalks. This degree of increased resolution, which for any angular movement of the wheel produces more pulses than the number of arms passing the sensor, is sufficient for most purposes. However, the resolution can be further increased by providing each stalk with two or more parallel slits.

Preferably, the widths of said branches are equal and, furthermore, said widths are preferably selected so that the width of the slit or slits is equal to the spacing between adjacent daisy wheel stalks at the radius of said radial zone. This ensures a regular pulse train equivalent to that obtained without the slits, but at a pulse frequency multiplied by an integer of two or more.

Each stalk may be widened in the form of a petal to accommodate the aperture or apertures and, conveniently, the apertured petal may be provided radially inwards of a character petal provided on the end of each daisy wheel stalk.

Although not limited thereto, the invention is especially applicable to a sensor in the form of a photoelectric detector which receives an interrupted light beam. Alternative non-contacting sensors may operate magnetically or capacitively.

IN THE ACCOMPANYING DRAWINGS

DESCRIPTION OF EMBODIMENTS

Figure 1:
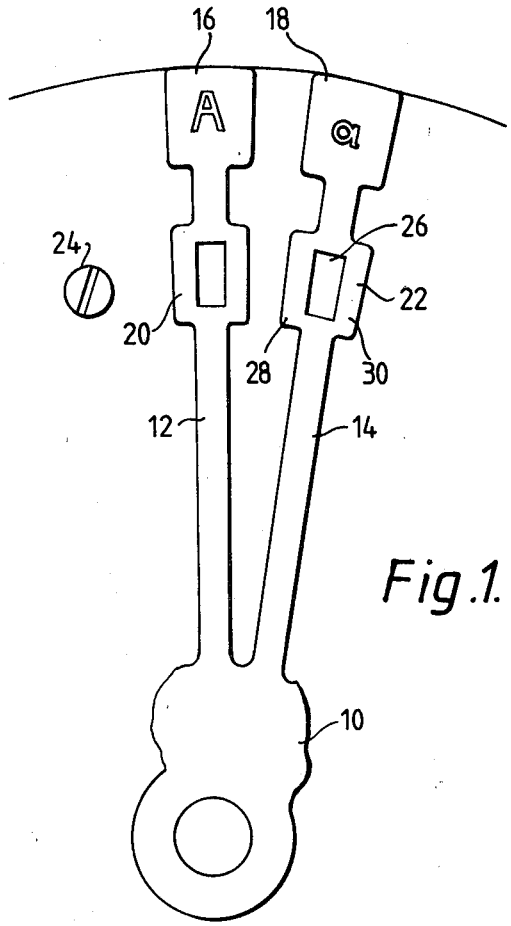
FIG. 1 shows a portion of a daisy wheel for a printer in accordance with the invention.

In FIG. 1 is shown a portion of a daisy wheel 10 provided with radial stalks carrying embossed character petals at their ends. Two adjacent stalks 12 and 14 are illustrated, with character petals 16 and 18, respectively.

Radially inwards of the character petals 16, 18, the stalks 12, 14 are provided with apertured sensor petals 20 and 22. These petals 20 and 22 are provided at a radial zone of the daisy wheel corresponding to the radial position of a sensor 24, for example a photo-electric detector for receiving a light beam interrupted by the apertured petals on the stalks of the daisy wheel.

Each apertured petal 20, 22 has a central longitudinal slit 26 dividing the petal into two branches 28 and 30. The branches 28, 30 are of equal width such that the width of the slit between them is equal to the spacing between the petals 20 and 22.

Figure 2:
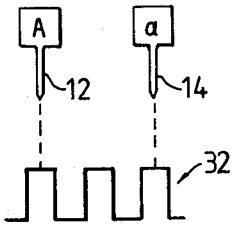
FIG. 2 shows the sensor output in relation to the number of stalks passing the sensor.

When the daisy wheel 10 rotates, the light beam is interrupted by the individual branches 28, 30 of the petals 20, 22, whereby the sensor 24 produces two pulses for each daisy wheel stalk. The relationship between the output pulses 32 and the stalks 12 and 14 is shown in FIG. 2.

Figure 3:
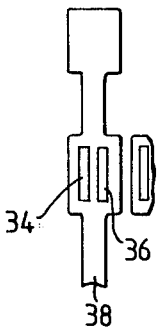
FIG. 3 shows a modification.

The modification of FIG. 3 will be clear without detailed description. In this modification, a pair of longitudinal slits 34 and 36 in each stalk 38 enables the sensor to produce three pulses per stalk. The widths of the branches and slits may again be selected to produce a regular pulse train.

In both cases, resolution of the positional information is considerably improved as compared to that obtained with a non-contacting sensor responsive to the interrupting action of non-divided stalks, sufficiently to ensure that the position of the daisy wheel is determined without ambiguity relative to a datum or home position which itself may be detected in various known ways.

The daisy wheel 10, rotated by a stepper motor or the like, preferably operating unidirectionally, will be controlled by a microcomputer utilising the positional information obtained from the sensor 24 to start and stop rotation of the daisy wheel in accordance with character selection, which may be effected by a keyboard in the case of a typewriter or by a computer in the case of information transmission. The invention is especially aimed at a low cost typewriter, such as a toy typewriter, and in such circumstances is capable of providing for precision monitoring of the position of a daisy wheel at relatively low cost.

We claim:

1. A printer having a printing head comprising:

a daisy wheel including a plurality of radial stalks, each of said stalks having a zone, the radial position of said zones being identical for all of said stalks;

at least one slit-like aperture at said zone of each said stalk, said at least one aperture being positioned so as to divide said stalk into at least two branches of equal circumferential width, said stalks and apertures being sized and configured such that equal circumferential widths are provided for said apertures and the spacing between branches of adjacent ones of said stalks;

means for rotating said daisy wheel; and non-contacting sensor means constructed and adapted for providing a signal in response to a sensed transition of an edge of one of said branches as said daisy wheel is rotated, whereby a train of said signals is generated at regular intervals during rotation of said wheel, the frequency of said signals being a multiple of the number of said stalks passing said sensor means.

2. The printer of claim 1 wherein said apertures are rectangular.

3. A printer according to claim 1 wherein each stalk is split at said zone by two slit-like apertures which divide each stalk into three branches.

4. A printer according to claim 1 wherein at said zone each stalk is widened in the form of a petal to accommodate the branching.

5. A printer according to claim 4 wherein said apertured petal is provided radially inwards of a character petal provided on the end of each daisy wheel stalk.

6. A printer according to claim 1 wherein said sensor is a photoelectric detector receiving a light beam interrupted by said apertured stalks of said rotating daisy wheel.

* * * * *